US012311215B2

(12) United States Patent
Kang

(10) Patent No.: US 12,311,215 B2
(45) Date of Patent: May 27, 2025

(54) MULTI-FUNCTIONAL EXERCISE DEVICE

(71) Applicant: In Tae Kang, Incheon (KR)

(72) Inventor: In Tae Kang, Incheon (KR)

(73) Assignee: KIT SPORTS Co., Ltd., Incheon (KR)

( * ) Notice: Subject to any disclaimer, the term of this patent is extended or adjusted under 35 U.S.C. 154(b) by 0 days.

(21) Appl. No.: 18/278,266

(22) PCT Filed: Jun. 27, 2022

(86) PCT No.: PCT/KR2022/009115

§ 371 (c)(1),
(2) Date: Aug. 22, 2023

(87) PCT Pub. No.: WO2023/277477

PCT Pub. Date: Jan. 5, 2023

(65) Prior Publication Data

US 2024/0123276 A1 Apr. 18, 2024

(30) Foreign Application Priority Data

Jun. 29, 2021 (KR) ..... 20-2021-0002050

(51) Int. Cl.
*A63B 21/055* (2006.01)
*A63B 21/00* (2006.01)
(Continued)

(52) U.S. Cl.
CPC ..... *A63B 21/0552* (2013.01); *A63B 21/04* (2013.01); *A63B 21/4034* (2015.10); *A63B 23/02* (2013.01)

(58) Field of Classification Search
CPC ..... A63B 21/0552; A63B 21/15; A63B 21/22; A63B 21/227; A63B 21/4041;
(Continued)

(56) References Cited

U.S. PATENT DOCUMENTS 1,950,174 A * 3/1934 Harrison ..... A63B 21/04 482/130
5,545,114 A * 8/1996 Gvoich ..... A63B 21/0552 482/142
(Continued)

FOREIGN PATENT DOCUMENTS

KR 20-0405273 Y1 1/2006
KR 20-0449833 Y1 8/2010
(Continued)

*Primary Examiner* — Zachary T Moore
(74) *Attorney, Agent, or Firm* — IP Legal Services, LLC

(57) ABSTRACT

The present invention relates to a multifunctional exercise equipment designed to allow a user to select and do various exercises, such as Pilates, fitness, and aerobic exercise, at low cost without the need for a large space at home or in the office. The multifunctional exercise equipment according to the present invention includes: a body part (100) supporting a user's upper body, the body part (100) including a body (110), a pedestal (120), a first holder (130), an elastic member (140), a variable length member (160) installed on the bottom surface of the body (110) in the length direction with the elastic member (140) therebetween, and a first support member (170) and a second support member (180) respectively screwed to the body (110); a first wing part (200) connected to one side of the lower portion of the body part (100) to support one foot of the user, the first wing part (200) including a body (210), a handle (220), a second holder (230), and a third support member (240); and a second wing part (300) connected to the other side of the lower portion of the body part (100) to support the other foot of the user, the second wing part (300) including a body (310), a handle (320), a third holder (330), and a fourth support member (340).

2 Claims, 11 Drawing Sheets

(51) Int. Cl.
*A63B 21/04* (2006.01)
*A63B 23/02* (2006.01)

(58) Field of Classification Search
CPC ..... A63B 21/4043; A63B 21/4045; A63B 21/4047; A63B 21/4049
See application file for complete search history.

(56) References Cited

U.S. PATENT DOCUMENTS

| | | | | |
|---|---|---|---|---|
| 8,075,453 | B1 | 12/2011 | Wilkinson | |
| 10,179,258 | B1 * | 1/2019 | Sabbagh ..... | A63B 21/0552 |
| 2002/0086779 | A1 | 7/2002 | Wilkinson | |
| 2004/0043873 | A1 | 3/2004 | Wilkinson et al. | |
| 2004/0204294 | A2 | 10/2004 | Wilkinson et al. | |
| 2005/0124471 | A1 | 6/2005 | Wilkinson | |

FOREIGN PATENT DOCUMENTS

| | | | |
|---|---|---|---|
| KR | 10-1173377 | B1 | 8/2012 |
| KR | 10-1593069 | B1 | 2/2016 |
| KR | 10-1827253 | B1 | 2/2018 |
| KR | 10-1845310 | B1 | 4/2018 |

* cited by examiner

MULTI-FUNCTIONAL EXERCISE DEVICE

CROSS REFERENCE TO RELATED APPLICATIONS

This application is a National Stage Patent Application of PCT International Patent Application No. PCT/KR2022/009115 (filed on Jun. 27, 2022) under 35 U.S.C. § 371, which claims priority to Korean Patent Application No. 20-2021-0002050 (filed on Jun. 29, 2021), the teachings of which are incorporated herein in their entireties by reference.

TECHNICAL FIELD

The present invention relates to a multifunctional exercise equipment, and more particularly, to a multifunctional exercise equipment designed to allow a user to select and do various exercises, such as Pilates, fitness, and aerobic exercise, at low cost without the need for a large space at home or in the office.

BACKGROUND ART

In recent years, as one of the ways to maintain health with the spread of the 5-day work week, many people go to gyms and do weight training, or women do Pilates exercises.

In addition, people frequently do aerobic exercise, such as swimming, walking, jogging, running, or stationary bicycle, in which sufficient oxygen is consumed continuously for a long time.

However, most of the conventional exercise equipment is designed to intensively strengthen only one muscle of the body. Therefore, in order to strengthen various muscles of the body, it is necessary to secure a large number of exercise equipment.

There is a disadvantage in that it takes a lot of money to secure a variety of exercise equipment and a large space is required to store a lot of exercise equipment.

In other words, a treadmill is a device that is installed indoors and mainly used for running and walking, and has a disadvantage of being expensive and having many breakdowns. Cost burden is incurred when using gym facilities. In addition to the travel time required, a user may feel discomfort due to the use by an unspecified number of people.

In addition, since the exercise equipment installed in the outdoor sports facility is only for a single exercise, there are many inconveniences in doing multiple exercises in combination. In addition, in order to separately install exercise equipment suitable for each type, there is a problem in that it takes a lot of space and installation costs.

Furthermore, as COVID-19, which has been sweeping the world in recent years, has made it difficult to use gyms and Pilates facilities, more time is spent at home, and thus, interest in exercise is increasing. However, there is no multifunctional exercise equipment on the market that can allow users to do Pilates, weights, and aerobic exercise at once.

Accordingly, there is an urgent need to develop multifunctional exercise equipment that can secure space and reduce installation costs while operating various functions in one device.

CITATION LIST

Patent Literature (Patent Literature 0001) Korean Utility Model Registration No. 20-0449833 (2010 Aug. 25)

(Patent Literature 0002) Korean Utility Model Registration No. 20-0405273 (2006 Jan. 11)

DETAILED DESCRIPTION OF THE INVENTION

Technical Problem

The present invention has been made in view of the problems of the prior art and needs, an object of the present invention is to provide a multifunctional exercise equipment that reduces costs for securing a variety of exercise equipment and does not require space for installing the exercise equipment.

Another object of the present invention is to provide a multifunctional exercise equipment that can easily combine Pilates, fitness, and aerobic exercise at home or in the office and can allow a user to do personal exercise without requiring travel time.

Further another object of the present invention is to provide a multifunctional exercise equipment that can allow a user to do Pilates, weights, and aerobic exercise at home even if it is difficult to use gyms or Pilates facilities due to the spread of infectious diseases.

Technical Solution

In order to achieve the objects of the present invention, a multifunctional exercise equipment includes: a body part (110) for supporting a user's upper body, wherein the body part (110) includes: 'C'-shaped processing parts (112) provided at each edge thereof and to which a tubing band (420) is connected; an elliptical through-hole (114) provided in a central portion of one side thereof; first insertion holes (116) provided on both sides of a top surface thereof and to which a handle-combined push-up bar (500) is detachably attached; a body (110) having second insertion holes (118) such that the second insertion holes (118) to which straight handles (600) are detachably attached are disposed to face each other with the through-hole (114) therebetween; pedestals (120) coupled to a bottom surface of the body (110) in a longitudinal direction and having anti-slip pads (120*b*) attached to both end portions of the top surface of the body (110); a plurality of first holders (130) having semicircular small concave holes (136) on left and right sides with a central 'U'-shaped large concave hole (134) therebetween and coupled to the bottom surface of the body (110) with a screw (132) so as to be adjacent to the processing part (112); an elastic member (140) having one end portion inserted into the small concave hole (136) such that the elastic member (140) is prevented from releasing from the small concave hole (136) by the engaging member (150); a variable length member (160) installed on the bottom surface of the body (110) in a longitudinal direction with the elastic member (140) therebetween, wherein a medium pipe (164) of a smaller diameter is housed in a large pipe (162) of a predetermined diameter, and a small pipe (166) of a smaller diameter is housed in the medium pipe (164); and a first support member (170) and a second support member (180) respectively screwed to the body (110) in a state of surrounding an outer circumferential surface of the large pipe (162);

a first wing part (200) connected to one side of a lower portion of the body part (100) to support one foot of a user, wherein the first wing part (200) includes: a body (210); a handle (220) assembled in a state where a large base plate (222) and a small base plate (224) face each other with the body therebetween and fixedly installed on a top surface of the body (210) in a width direction; second holders (230) coupled to a bottom surface of the body (210) with screws (232) with the small pipe (166) of the body (110) therebetween; and a third support member (240) surrounding one side of an outer circumferential surface of the small pipe (166); and a second wing part (300) connected to another side of the lower portion of the body part (100) to support another foot of the user, wherein the second wing part (300) includes: a body (310); a handle (320) assembled in a state where a large base plate (322) and a small base plate (324) face each other with the body therebetween and fixedly installed on a top surface of the body (310) in a width direction; third holders (330) coupled to a bottom surface of the body (310) with screws (332) with the small pipe (166) of the body (110) therebetween; and a fourth support member (340) surrounding one side of an outer circumferential surface of the small pipe (166).

In the present invention, wheels (224*a*) are rotatably connected to both sides of an upper end of the small base plate (224) of the first wing part (200), and wheels (324*a*) are rotatably connected to both sides of an upper end of the small base plate (324) of the second wing part (300).

Advantageous Effects

A multifunctional exercise equipment of the present invention as described above has the following effects.

First, it is possible for a user to do various types of Pilates, weight training, and aerobic training after storing the multifunctional exercise equipment having a compact size under a desk or in a corner of a veranda and moving the multifunctional exercise equipment to a desired exercise place through wheels 224*a* and 334*a*. Therefore, it is possible to reduce costs for securing a variety of exercise equipment and it is unnecessary to secure space for installing the exercise equipment.

Second, it is possible for a user to do a combination of Pilates, fitness, and aerobic exercise easily at home or in the office without using gym facilities, and it is possible for a user to do individual exercise without travel time.

Third, even if it is difficult for a user to use gyms or Pilates facilities due to the spread of infectious diseases, there is an advantage of being able to do Pilates, weights, and aerobic exercise at home.

MODE FOR CARRYING OUT THE INVENTION

Hereinafter, a multifunctional exercise equipment according to a preferred embodiment of the present invention will be described in detail with reference to the accompanying drawings.

The terms or words as used herein should not be construed as being limited to ordinary or dictionary meanings. The terms or words should be construed as meanings and concepts consistent with the technical idea of the present invention, based on the principle that the inventors can appropriately define the concept of the terms in order to explain their invention in the best way.

Figure 1:
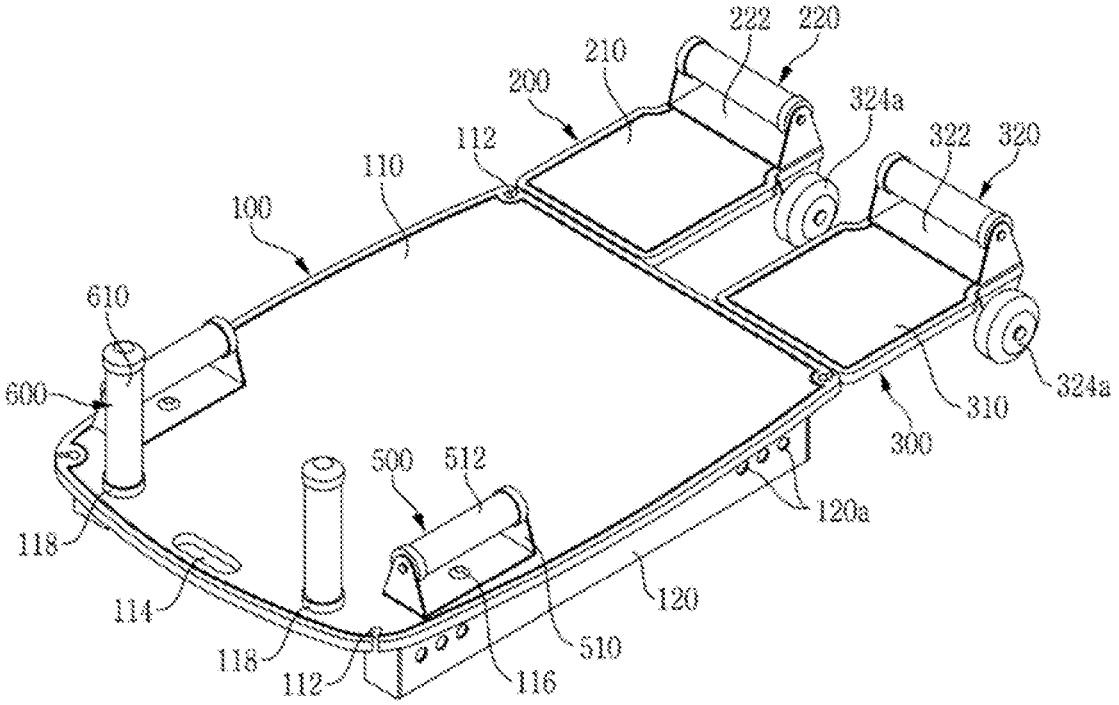
FIG. 1 is a perspective showing the top of a multifunctional exercise equipment according to an embodiment of the present invention.
Figure 2:
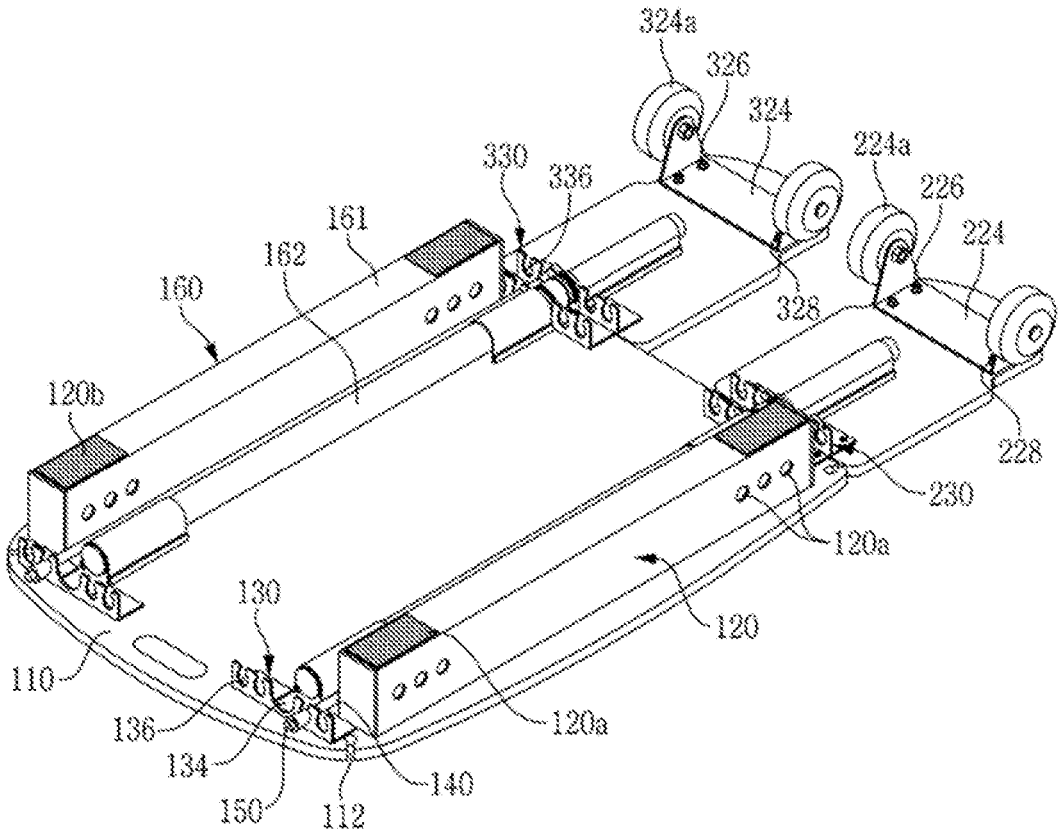
FIG. 2 is a perspective view showing the bottom of the multifunctional exercise equipment according to the present invention.
Figure 3:
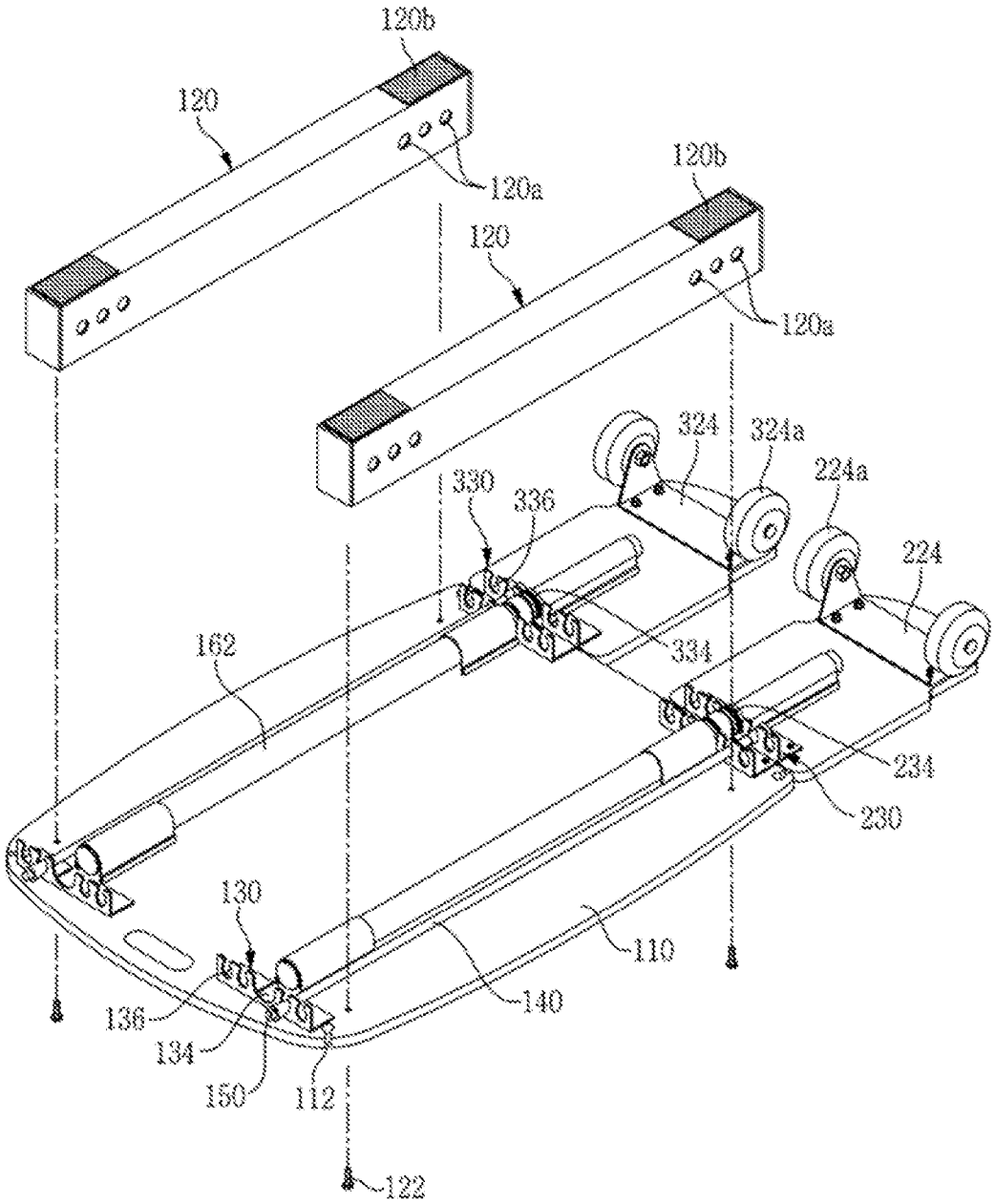
FIG. 3 is a partial exploded perspective view of FIG. 2.

FIG. 1 is a perspective showing the top of a multifunctional exercise equipment according to an embodiment of the present invention, FIG. 2 is a perspective view showing the bottom of the multifunctional exercise equipment according to the present invention, and FIG. 3 is a partial exploded perspective view of FIG. 2.

Figure 4:
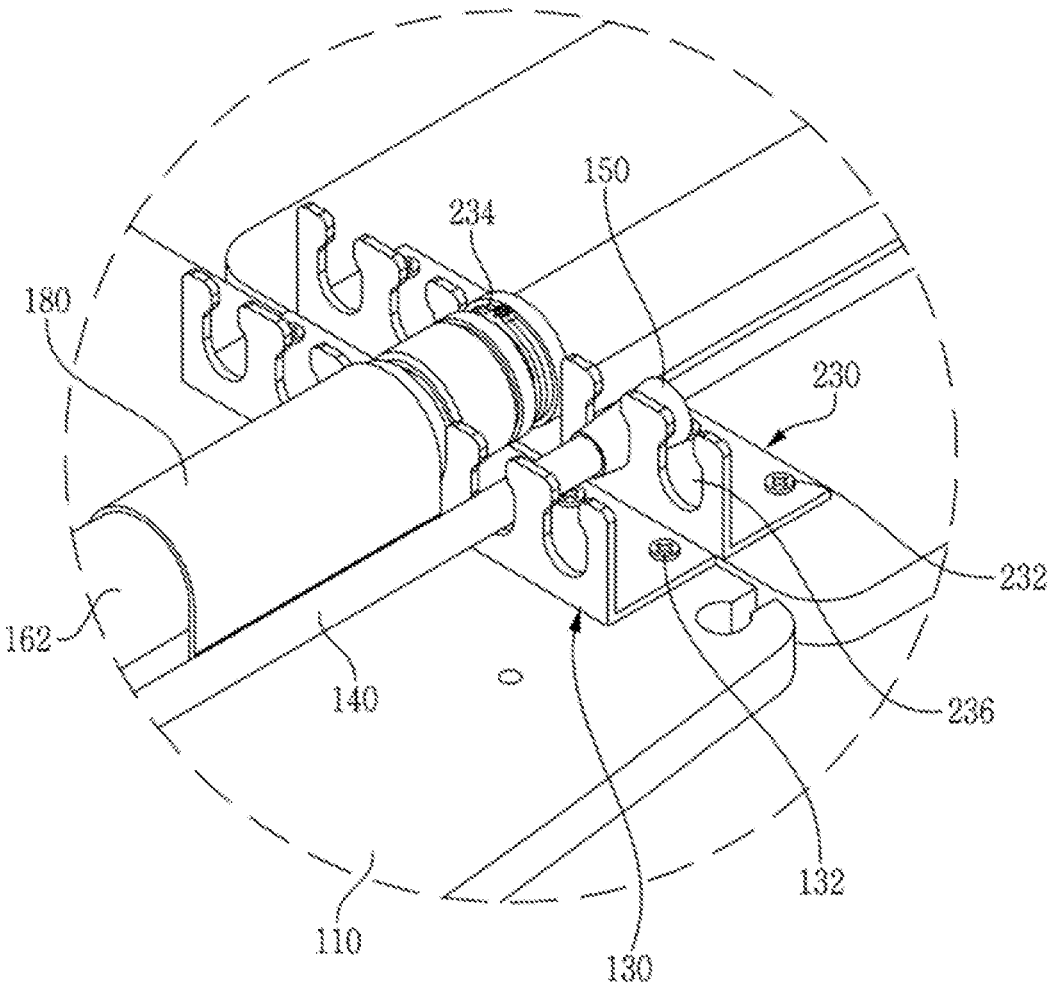
FIG. 4 is an enlarged view of a main part of FIG. 3.
Figure 5:
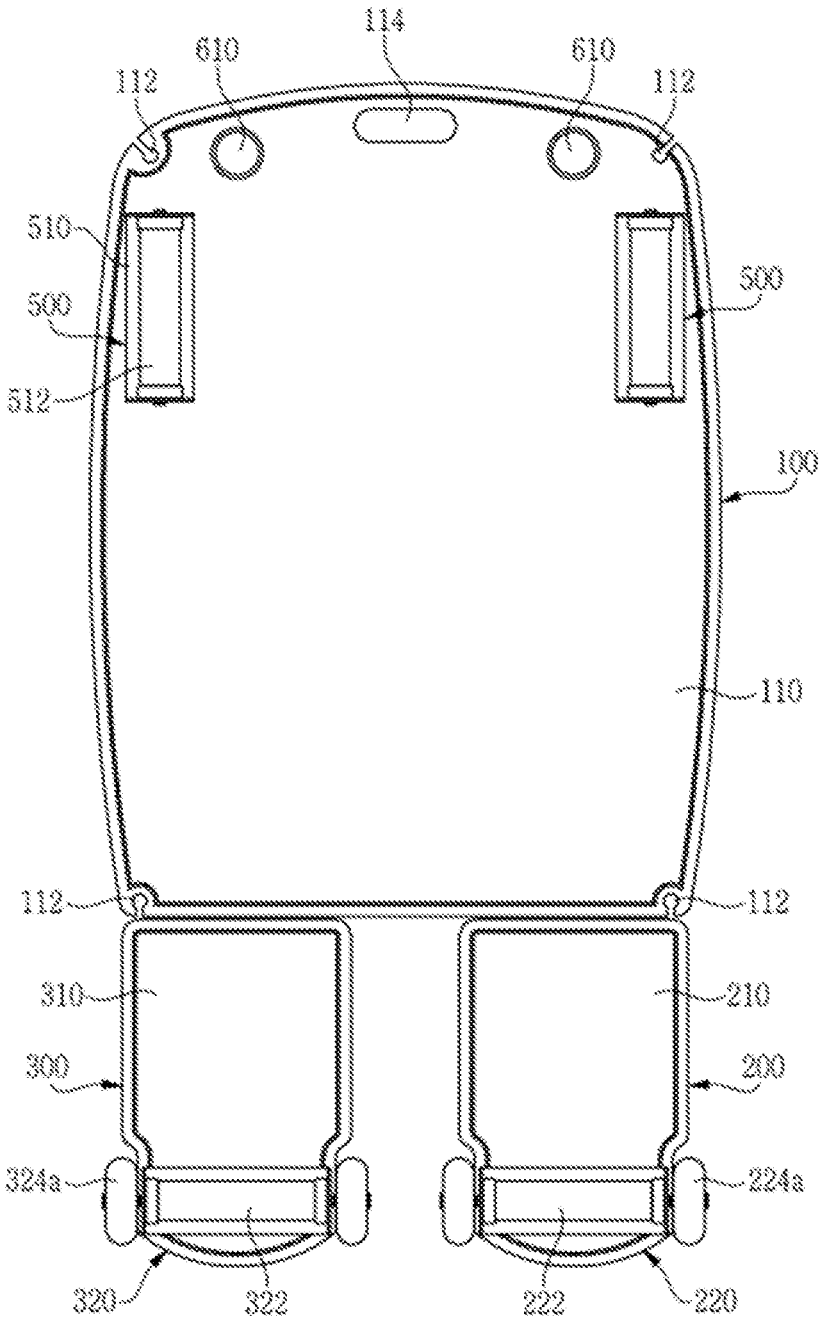
FIG. 5 is a plan view showing the multifunctional exercise equipment according to the present invention.
Figure 6:
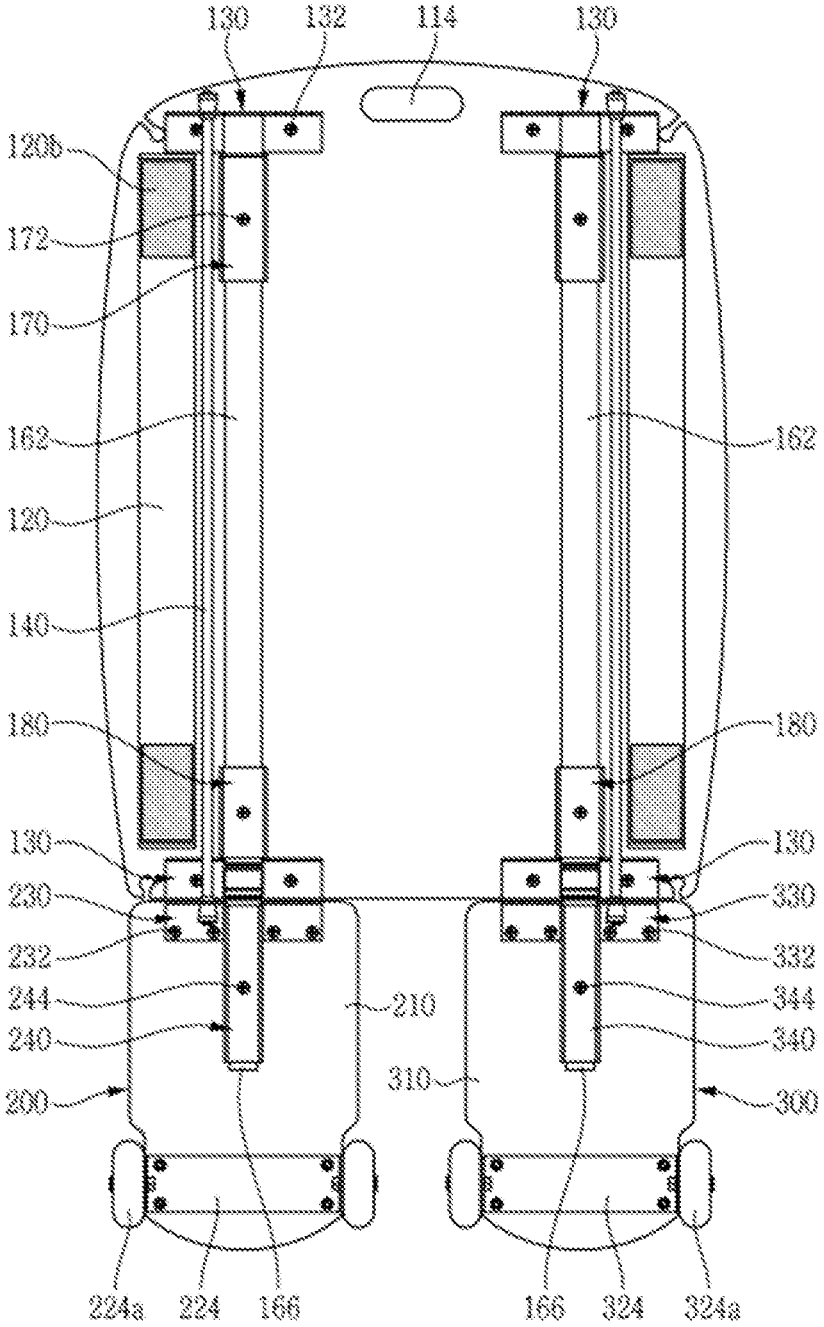
FIG. 6 is a bottom view showing the multifunctional exercise equipment according to the present invention.

FIG. 4 is an enlarged view of a main part of FIG. 3, FIG. 5 is a plan view showing the multifunctional exercise equipment according to the present invention, and FIG. 6 is a bottom view showing the multifunctional exercise equipment according to the present invention.

Figure 7:
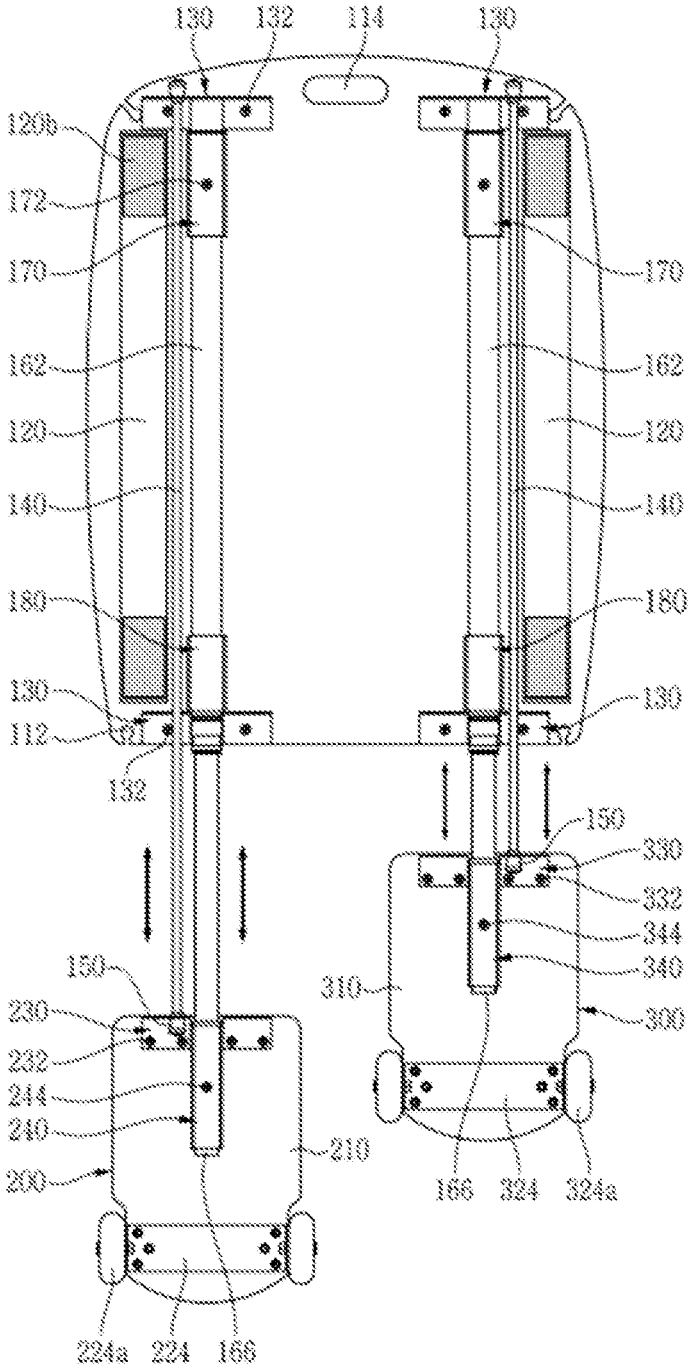
FIG. 7 is a bottom view showing a state of use of the multifunctional exercise equipment according to the present invention.
Figure 8:
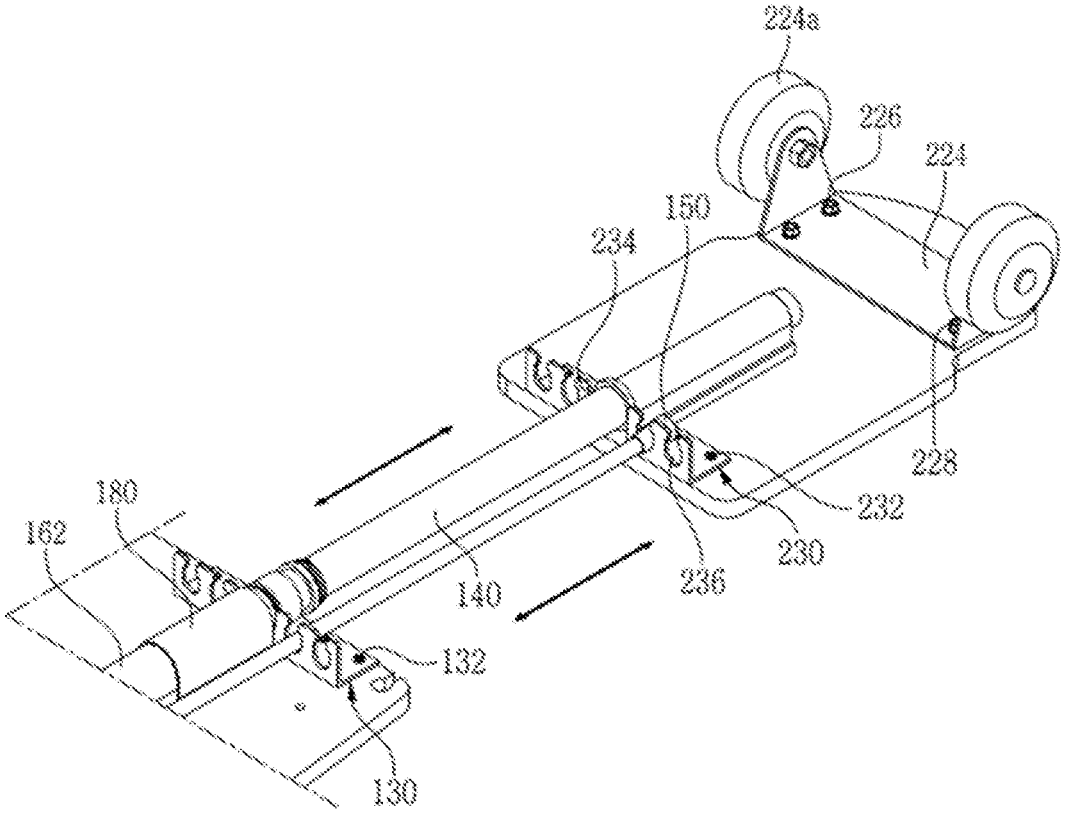
FIG. 8 is a partial perspective view showing a state of use of the multifunctional exercise equipment according to the present invention.
Figure 9:
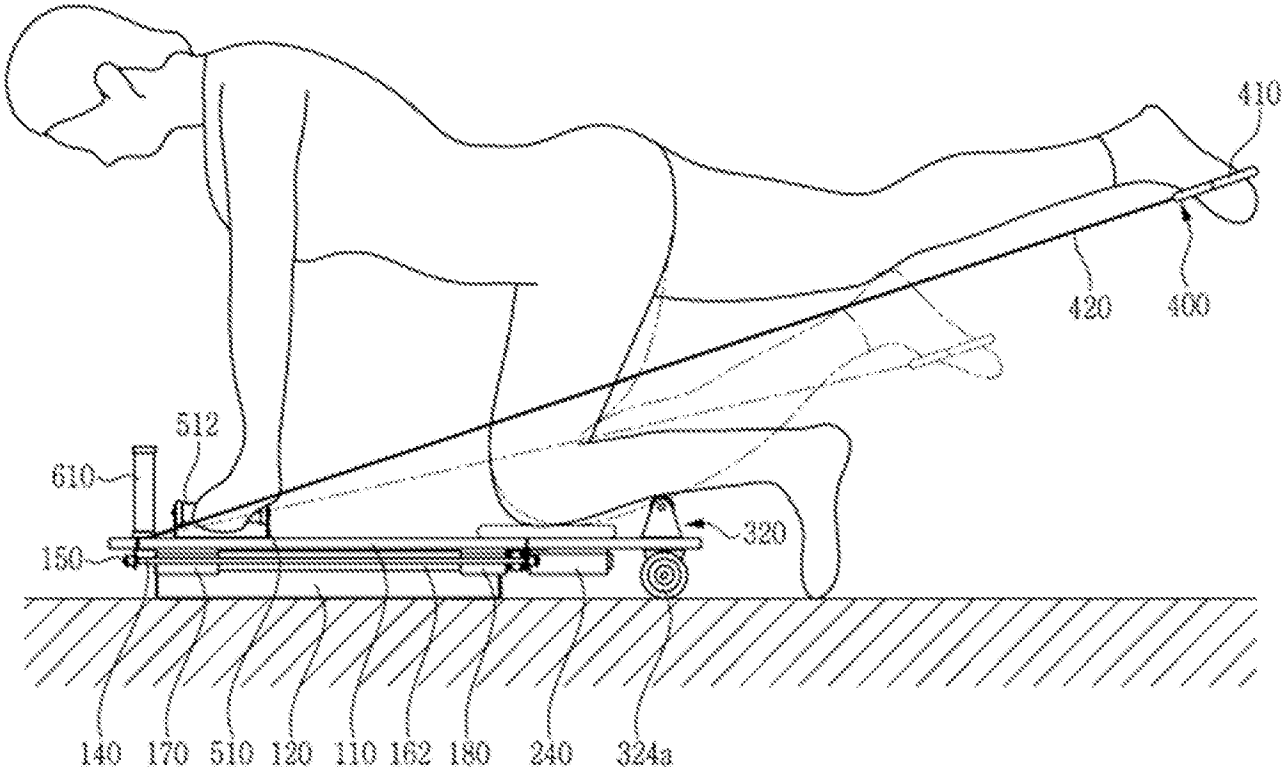
FIGS. 9 to 11 are side views showing a state of use of the multifunctional exercise equipment according to the present invention.
Figure 10:
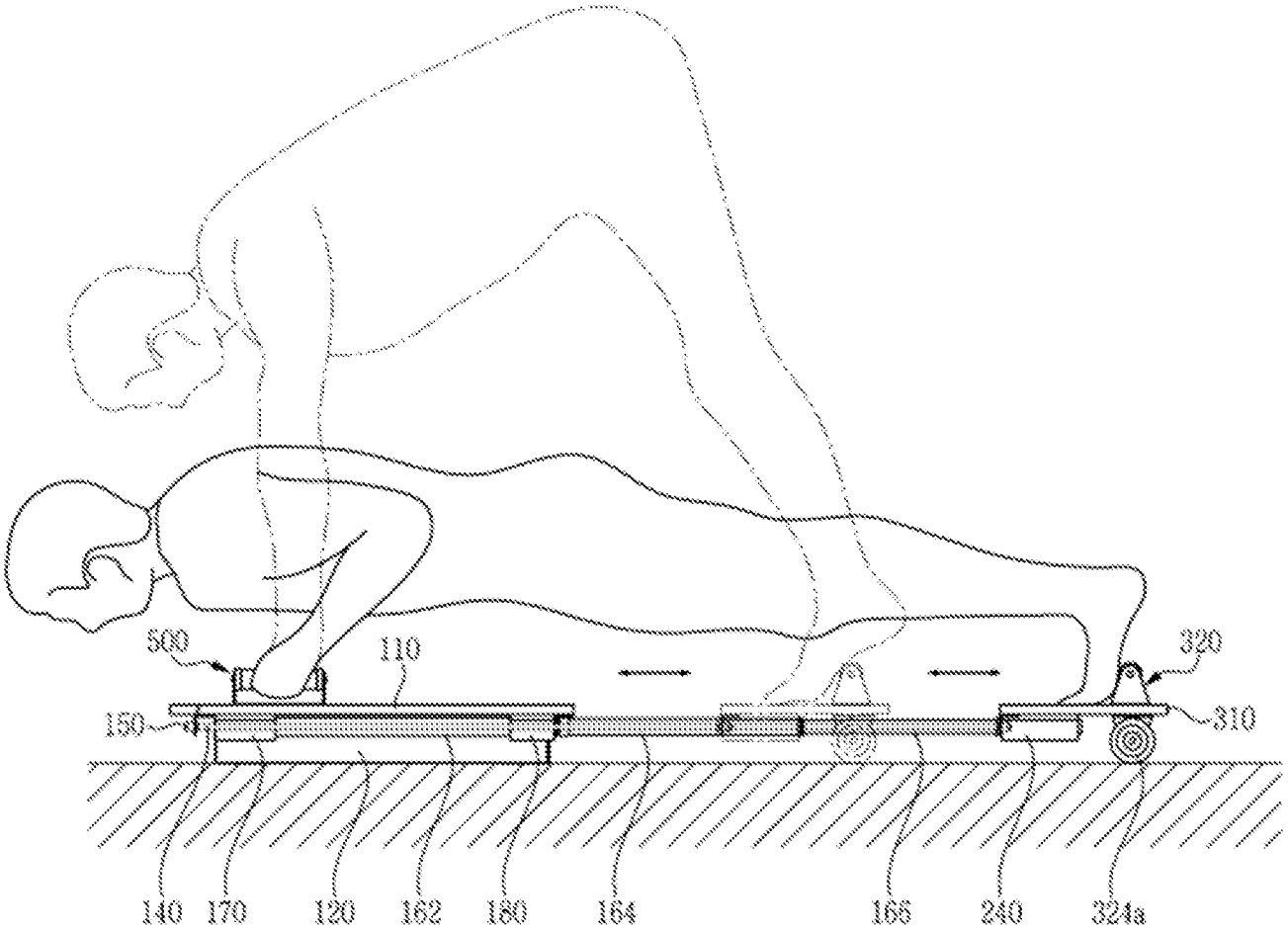
Figure 11:
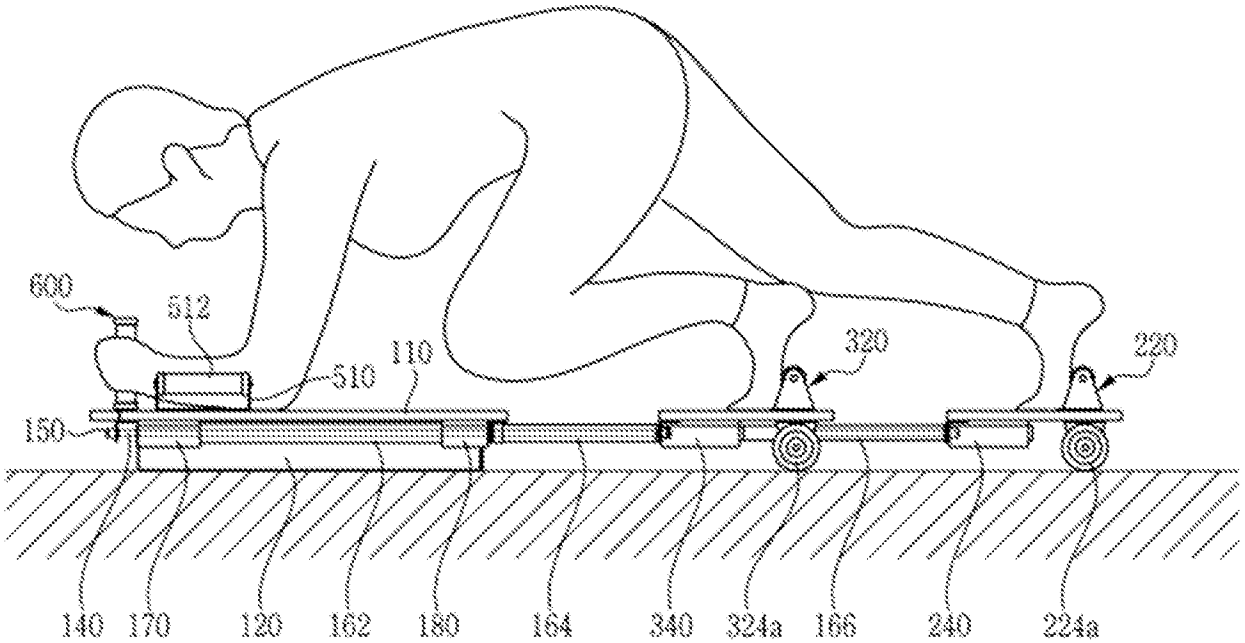

FIG. 7 is a bottom view showing a state of use of the multifunctional exercise equipment according to the present invention, FIG. 8 is a partial perspective view showing a state of use of the multifunctional exercise equipment according to the present invention, and FIGS. 9 to 11 are side views showing a state of use of the multifunctional exercise equipment according to the present invention.

Referring to FIGS. 1 to 7, the multifunctional exercise equipment according to the present invention includes a body part 100, a first wing part 200, and a second wing part 300.

The body part 100 mainly supports a user's upper body. Referring to FIG. 1, 'C'-shaped processing parts 112 pass through corners of a body 110 having a width of about 45 cm, a length of about 60 cm, and a height of about 1 cm, such that an end portion of a tubing band 420 of a tubing band ass'y 400 to be described below is fitted thereto. An elliptical through-hole 114 is formed in the central portion of one side such that a user moves the body part 100 while inserting his or her hand thereinto.

At this time, the material of the body 110 is not particularly limited, but a wood material is preferable in consideration of external aesthetics or luxury, and aluminum or synthetic resin is also possible.

Referring to FIG. 9, the tubing band ass'y 400 can stimulate various parts by using the tension of the band and can enable all of stretching, aerobic, and strength training. One end portion of the tubing band 420 is fixed to the inside of the triangular holder 400 such that the user holds it with his or her hand or put his or her foot therein. The other end portion of the tubing band 420 is fitted to the processing part 112.

In addition, first insertion holes 116 having a predetermined diameter are formed on both left and right sides of the top surface of the body 110 such that handle-combined push-up bars 500 are detachably attached thereto. Second insertion holes 118 are formed to face each other with the through hole 114 therebetween, such that straight handles 600 are detachably attached thereto.

In the handle-combined push-up bar 500, a protruding rod (not shown) of a predetermined length, which can be freely inserted into and removed from the first insertion hole 116, is fixedly attached to a bottom surface of a base plate 510 having a '⊏'-shaped cross-section. Both end portions of the handle 512 having a rod shape are screwed between the upper ends of the base plate 510. The handle-combined push-up bar 500 is rotatable at an angle convenient for the user to use while riding on the top surface of the body 110 in a state of being inserted into the first insertion hole 116 through the protruding bar.

In the straight handle 600, a protruding rod (not shown) of a predetermined length, which is inserted into and removed from the second insertion hole 118, is fixedly attached to a lower portion of a handle 610 having a rod shape.

In addition, referring to FIGS. 2, 3, and 6, pedestals 120 having a height of about 5 cm are coupled to the bottom surface of the body 110 in the left and right longitudinal directions. Both end portions of the pedestals 120 are coupled to the body 110 through screws 122, and anti-slip pads 120*b* are attached to both end portions of the top surfaces of the pedestals 120.

In addition, a plurality of first holders 130 having an approximately 'L'-shaped cross-section are coupled to the bottom surface of the body 110 so as to be adjacent to the processing part 112. In the first holder 130, semicircular small concave holes 136 are formed on the left and right sides with a 'U'-shaped large concave hole 134 therebetween.

In addition, since a plurality of through-holes 120*a* having a predetermined diameter are formed at equal intervals in the longitudinal direction of the pedestal 120, the straight handle 600 is selectively attached to or detached from the through-hole 120*a*.

In addition, one end portion of an elastic member 140 is inserted into the small concave hole 136, and the other end portion of the elastic member 140 is coupled through another small concave hole 136 to a second holder 230 to be described below. An engaging member 150 having a cap shape prevents the elastic member 140 from being released from the small concave hole 136.

At this time, in the present invention, although a flexible tubing band 420 is provided as the elastic member 140, it is not necessarily limited thereto, and a rubber band or a spring is also possible.

In addition, a length-variable member 160 is installed on the bottom surface of the body 110 in the longitudinal direction with the elastic member 140 therebetween. In the length-variable member, a medium pipe 164 of a smaller diameter is housed in a large pipe 162 of a predetermined diameter. A small pipe 166 having a smaller diameter is housed in the medium pipe 164.

At this time, referring to FIG. 6, a plurality of screws (not shown) are screwed to a bottom surface of a first support member 170 on the top surface of the body 110 in a state where the first support member 170 having a hollow tunnel shape surrounds one side of the outer circumferential surface of the large pipe 162.

In addition, a plurality of screws (not shown) are screwed to a bottom surface of a second support member 180 on the top surface of the body 110 in a state where the second support member 180 having the same shape as the first support member 170 surrounds the other side of the outer circumferential surface of the large pipe 162.

In addition, since a screw 172 passes through the first support member 170 and is coupled to the large pipe 162 at a predetermined depth, the large pipe 162 is prevented from being separated from the first support member 170.

Referring to FIGS. 2, 5, and 6, the first wing part 200 is connected to one side of the lower portion of the body part 100 for convenience so as to mainly support one foot of the user. The handle 220 is fixedly installed on one side of the top surface of the body 210 having a width of about 16 cm, a length of about 25 cm, and a height of about 1 cm in the width direction. In the handle 220, in a state where the large base plate 222 and the small base plate 224 having a '⊏'-shaped cross-section face each other with the body 210 therebetween, a bolt 226 sequentially passes through the corners of the large base plate 222 and the small base plate 224 and is assembled with a nut 228.

In addition, the wheels 224*a* are rotatably connected to both sides of the upper end of the small base plate 224.

Also, referring to FIGS. 3 and 4, the second holder 230 is coupled to the bottom surface of the body 210 with a screw 232 with the small pipe 166 therebetween. The second holder 230 has small concave holes 236 formed on the left and right sides with the central 'U'-shaped large concave hole 234 therebetween.

In addition, after the other end portion of the elastic member 140 is inserted into the small concave hole 236, separation from the small concave hole 236 is prevented by the engaging member 150. One end portion of the large pipe 162 is supported across the large concave hole 134 of the first holder 130 and the large concave hole 234 of the second holder 230.

In addition, a plurality of screws (not shown) are screwed to a bottom surface of a third support member 240 on the top surface of the body 210 in a state where the third support member 240 having the same shape as the first support member 170 surrounds the other side of the outer circumferential surface of the small pipe 166.

In addition, since a screw 244 passes through the third support member 240 and is coupled to the small pipe 166 at a predetermined depth, the lifting phenomenon is prevented in the extending or retracting process of the small pipe 166.

Referring to FIGS. 2, 5, and 6, the second wing part 300 is connected to the other side of the lower portion of the body part 100 for convenience so as to mainly support the other foot of the user. The handle 320 is fixedly installed on one side of the top surface of the body 310 in the width direction. In the handle 320, in a state where the large base plate 322 and the small base plate 324 face each other with the body 310 therebetween, a bolt 326 sequentially passes through the corners of the large base plate 322 and the small base plate 324 and is assembled with a nut 328.

In addition, the wheels 324*a* are rotatably connected to both sides of the upper end of the small base plate 324.

In addition, referring to FIGS. 3 and 4, the third holder 330 is coupled to the bottom surface of the body 310 with a screw 332 with the small pipe 166 therebetween. The third holder 330 has small concave holes 336 formed on the left and right sides with the large concave hole 334 therebetween.

In addition, after the other end portion of the elastic member 140 is inserted into the small concave hole 336, separation from the small concave hole 336 is prevented by the engaging member 150. One end portion of the large pipe 162 is supported across the large concave hole 134 of the first holder 130 and the large concave hole 334 of the second holder 330.

In addition, a plurality of screws (not shown) are screwed to a bottom surface of a fourth support member 340 on the top surface of the body 310 in a state where the fourth support member 340 having the same shape as the first support member 170 surrounds the other side of the outer circumferential surface of the small pipe 166.

In addition, since a screw 344 passes through the fourth support member 340 and is coupled to the small pipe 166 at a predetermined depth, the lifting phenomenon is prevented in the extending or retracting process of the small pipe 166.

Hereinafter, the operation of the present invention having the above configuration will be described.

First, the multifunctional exercise equipment stored under the desk or in the corner of the veranda is moved to a desired location. That is, the user's hand is put in the through-hole and moves the multifunctional exercise equipment to a desired exercise place through the wheels 224*a* and 334*a* of the multifunctional exercise equipment.

Thereafter, the end portion of the tubing band 420 is fitted to the processing part 114 of the body 110, the handle-combined push-up bar 500 is connected to the first insertion hole 116 of the body 110, and the straight handle 600 is connected to the second insertion hole 118.

FIG. 9 shows that the user does Pilates by using the multifunctional exercise equipment according to the present invention. Referring to this, the user holds the handle-combined push-up bars 500 with his or her two hands and brings his or her left knee into close contact with the top surface of the body 210 of the first wing part 200.

In addition, if the right foot is inserted into the holder 400 of the tubing band ass'y 400 and then the right foot is pulled and stretched around the knee, the length of the tubing band 420 is decreased or increased in conjunction with this. This elasticity is useful for strengthening the muscles of the lower body and stabilizing the body.

FIG. 10 shows that the user does weight training by using the multifunctional exercise equipment according to the present invention. Referring to this, the user holds the handle-combined push-up bar 500 with his or her two hands, brings his or her two feet into close contact with the top surfaces of the bodies 210 and 310 of the first wing part 200 and the second wing part 300, and spaces his or her body apart from the multifunctional exercise equipment so as to have a predetermined distance in a vertical direction.

Thereafter, if the user repeats the action of pulling or pushing his or her two feet forward, the length of the tubing band 420 is decreased or increased in conjunction with this, and thus, the first wing part 200 and the second wing part 300 move toward or away from the body part 100. In this manner, the elasticity of the tubing band 420 is useful for holding the center of the body through core exercise.

FIG. 11 shows that the user does aerobic training by using the multifunctional exercise equipment according to the present invention. Referring to this, if the user holds the straight handle 600 with his or her two hands, brings one foot in close contact with the top surface of the body 210 of the first wing part 200 and the other foot in close contact with the top surface of the body 310 of the second wing part 300, and then repeats the action of alternately moving his or her two feet forward and backward, the length of the tubing band 420 is decreased or increased in conjunction with this, and thus, the first wing part 200 and the second wing part 300 move toward or away from the body part 100. In this manner, the elasticity of the tubing band 420 is useful for improving aerobic capacity through mounting climbing exercise.

FIGS. 9 to 11 show an example of Pilates, weight training, and aerobic training using the multifunctional exercise equipment according to the present invention has been described, but the present invention is not necessarily limited thereto. The user can do various other actions other than those shown in the drawings.

In the above process, according to the present invention, it is possible for a user to do various types of Pilates, weight training, and aerobic training after storing the multifunctional exercise equipment having a compact size under a desk or in a corner of a veranda and moving the multifunctional exercise equipment to a desired exercise place through the wheels 224*a* and 334*a*. Therefore, it is possible to reduce costs for securing a variety of exercise equipment and it is unnecessary to secure space for installing the exercise equipment.

In addition, it is possible to do a combination of Pilates, fitness, and aerobic exercise easily at home or in the office without using gym facilities, and it is possible to do individual exercise without travel time.

In addition, even if it is difficult to use gyms or Pilates facilities due to the spread of infectious diseases, there is an advantage of being able to do Pilates, weights, and aerobic exercise at home.

As described above, the multifunctional exercise equipment according to the present invention has been described with reference to the illustrated drawings, but the present invention is not limited by the embodiments and drawings disclosed herein, and various modifications can be made by those of ordinary skill in the art within the scope of the technical idea of the present invention.

DESCRIPTION OF SYMBOLS

| | |
|---|---|
| 100: | body part |
| 110, 210, 310: | body |
| 120: | pedestal |
| 130: | first holder |
| 140: | elastic member |
| 150: | engaging member |
| 160: | variable length member |
| 170: | first support member |
| 180: | second support member |
| 200: | first wing part |
| 230: | second holder |
| 240: | third support member |
| 300: | second wing part |
| 330: | third holder |
| 400: | tubing band ass'y |
| 500: | handle-combined push-up bar |
| 600: | straight handle |

The invention claimed is:

1. The multifunctional exercise equipment comprising:

a body part for supporting a user's upper body, wherein the body part includes:

C-shaped processing parts provided at each edge thereof and to which a tubing band is connected;

an elliptical through-hole provided in a central portion of one side thereof;

first insertion holes provided on both sides of a top surface thereof and to which a handle-combined push-up bar is detachably attached;

a body having second insertion holes such that the second insertion holes to which straight handles are detachably attached, are disposed to face each other with the through-hole therebetween;

pedestals coupled to a bottom surface of the body in a longitudinal direction and having anti-slip pads attached to both end portions of the top surface of the body;

a plurality of first holders having semicircular small concave holes on left and right sides with a central U-shaped large concave hole therebetween and coupled to the bottom surface of the body with a screw so as to be adjacent to the processing part;

an elastic member having one end portion inserted into the small concave hole such that the elastic member is prevented from releasing from the small concave hole by the engaging member;

a variable length member installed on the bottom surface of the body in a longitudinal direction with the elastic member therebetween, wherein a medium pipe of a smaller diameter is housed in a large pipe of a predetermined diameter, and a small pipe of a smaller diameter is housed in the medium pipe; and a first support member and a second support member respectively screwed to the body in a state of surrounding an outer circumferential surface of the large pipe;

a first wing part connected to one side of a lower portion of the body part to support one foot of a user, wherein the first wing part includes:

a first body;

a handle assembled in a state where a large base plate and a small base plate face each other with the first body therebetween and fixedly installed on a top surface of the first body in a width direction;

second holders coupled to a bottom surface of the first body with screws with the small pipe of the first body therebetween; and a third support member surrounding one side of an outer circumferential surface of the small pipe; and a second wing part connected to another side of the lower portion of the body part to support another foot of the user, wherein the second wing part includes:

a second body;

a handle assembled in a state where a large base plate and a small base plate face each other with the second body therebetween and fixedly installed on a top surface of the second body in a width direction;

third holders coupled to a bottom surface of the second body with screws with the small pipe of the second body therebetween; and a fourth support member surrounding one side of an outer circumferential surface of the small pipe.

2. The multifunctional exercise equipment of claim 1, wherein wheels are rotatably connected to both sides of an upper end of the small base plate of the first wing part, and wheels are rotatably connected to both sides of an upper end of the small base plate of the second wing part.

* * * * *